United States Patent [19]

Cade

[11] 4,249,884

[45] Feb. 10, 1981

[54] BURNER CONTROL APPARATUS WITH STABILIZED PILOT FLAME TIMING INTERVAL

[75] Inventor: Phillip J. Cade, Winchester, Mass.

[73] Assignee: Electronics Corporation of America, Cambridge, Mass.

[21] Appl. No.: 864,685

[22] Filed: Dec. 27, 1977

[51] Int. Cl.[3] ..... F23N 5/00

[52] U.S. Cl. ..... 431/31; 431/46; 431/78

[58] Field of Search ..... 431/31, 45, 46, 78

[56] References Cited

U.S. PATENT DOCUMENTS

| | | | |
|---|---|---|---|
| 3,008,517 | 11/1961 | Pierz | 431/31 X |
| 3,223,138 | 12/1965 | Brown | 431/31 X |
| 3,266,551 | 8/1966 | Guiffrida | 431/45 X |
| 3,393,037 | 7/1968 | Guiffrida et al. | 431/31 X |
| 3,644,074 | 2/1972 | Cade | 431/46 X |
| 3,840,322 | 10/1974 | Cade | 431/78 |

*Primary Examiner*—Carroll B. Dority, Jr.
*Assistant Examiner*—Randall L. Green
*Attorney, Agent, or Firm*—Charles E. Pfund

[57] ABSTRACT

Burner control apparatus includes a control device for actuating an ignition control means, and a timing circuit for providing an ignition timing interval which extends beyond flame detection for a timed interval. The timing circuit is actuated in response to a request for burner operation and the control device is energized in response to the actuated timing circuit. The control device is maintained energized if a signal from the flame sensor is received before the end of the ignition timing interval, and the control device is deenergized and lockout circuitry is energized in the absence of a signal from the flame sensor. Main fuel supply is delayed for the timed interval to provide pilot flame stabilization.

11 Claims, 2 Drawing Figures

BURNER CONTROL APPARATUS WITH STABILIZED PILOT FLAME TIMING INTERVAL

CROSS-REFERENCE TO RELATED APPLICATION

This application is related to applicant's U.S. Pat. No. 4,113,419, the disclosure of which is incorporated herein by reference.

BACKGROUND OF THE INVENTION

This invention relates to electrical control circuitry and more particularly to electrical control circuitry particularly adapted for use in burner control systems.

Burner control systems are designed both to monitor the existence of flame in the supervised combustion chamber and to time sequences of operation of burner controls. Safety of burner operation is a prime consideration in the design of burner control systems. For example, if fuel is introduced into the combustion chamber and ignition does not take place within a reasonable time, an explosive concentration of fuel may accumulate in the combustion chamber. The burner control system should reliably monitor the existence of flame in the combustion chamber, accurately time a trial-for-ignition interval, inhibit ignition if a false flame signal is present, and shut down the burner in safe condition whenever a potentially dangerous condition exists. Examples of such burner control systems are disclosed in my U.S. Pat. No. 3,840,322.

Among the considerations in burner control system design are reliability of operation, manufacturing cost, the provision of precise timing cycles (particularly those of short duration), and the nature of the response of the burner control to a flame failure condition after flame has been established, for example, an immediate shut down of the burner system, an immediate attempt to re-establish flame, or an attempt to re-establish flame only after a pre-ignition (purge) interval.

In burner control systems as above-identified and particularly those disclosed and claimed in applicant's referenced copending application, one problem that has been encountered involves the problem of extinguishing the pilot flame upon application of main fuel supply to the combustion chamber. This problem is particularly aggravated if main fuel supply is initiated during the time when the pilot flame is not fully established in the stabilized condition and the electric ignition spark is removed at the time of application of main fuel. The prior art attempts to solve this problem have been relatively complex and expensive and do not provide the desired reliability at a cost and complexity level which is consistent with providing this feature to the full range of size for burner installations.

BRIEF SUMMARY OF THE PRESENT INVENTION

The present invention provides for pilot flame stabilization interval timed precisely from the instant of flame detection with consequent control of ignition and main fuel application to provide a simple and reliable system for assuring establishment of the main flame by providing a fully stabilized pilot flame which is relatively immune from being extinguished by the application of main fuel to the combustion chamber.

It is, accordingly, a principal object of the present invention to provide a simple, economical and reliable control circuit featuring a further timing interval for stabilization of pilot flame prior to extinguishing ignition and application of main fuel to the combustion chamber.

A further object of the invention is to provide a system having the features described which can be achieved with very few additional components thus enhancing reliability and providing the desired additional functions and beneficial result with substantial economies relative to prior art systems thereby making this improved level of safety economically feasible in a wide range of burner applications.

These and other objects will become apparent to those skilled in the art upon understanding the present specification and the accompanying drawings.

DESCRIPTION OF THE PREFERRED EMBODIMENT

The present invention is readily applicable to a wide variety of burner control systems and in particular can be applied with the addition of only a few electronic components to the circuits disclosed in applicant's referenced U.S. Pat. No. 4,113,419. For the purpose of illustrating the invention the present specification will show the application of the invention to the circuit of FIG. 2 of applicant's referenced copending application and from this teaching it will be apparent to those skilled in the art how the invention can be applied to the other circuits disclosed in that application and applied generally to burner control systems.

Figure 2:
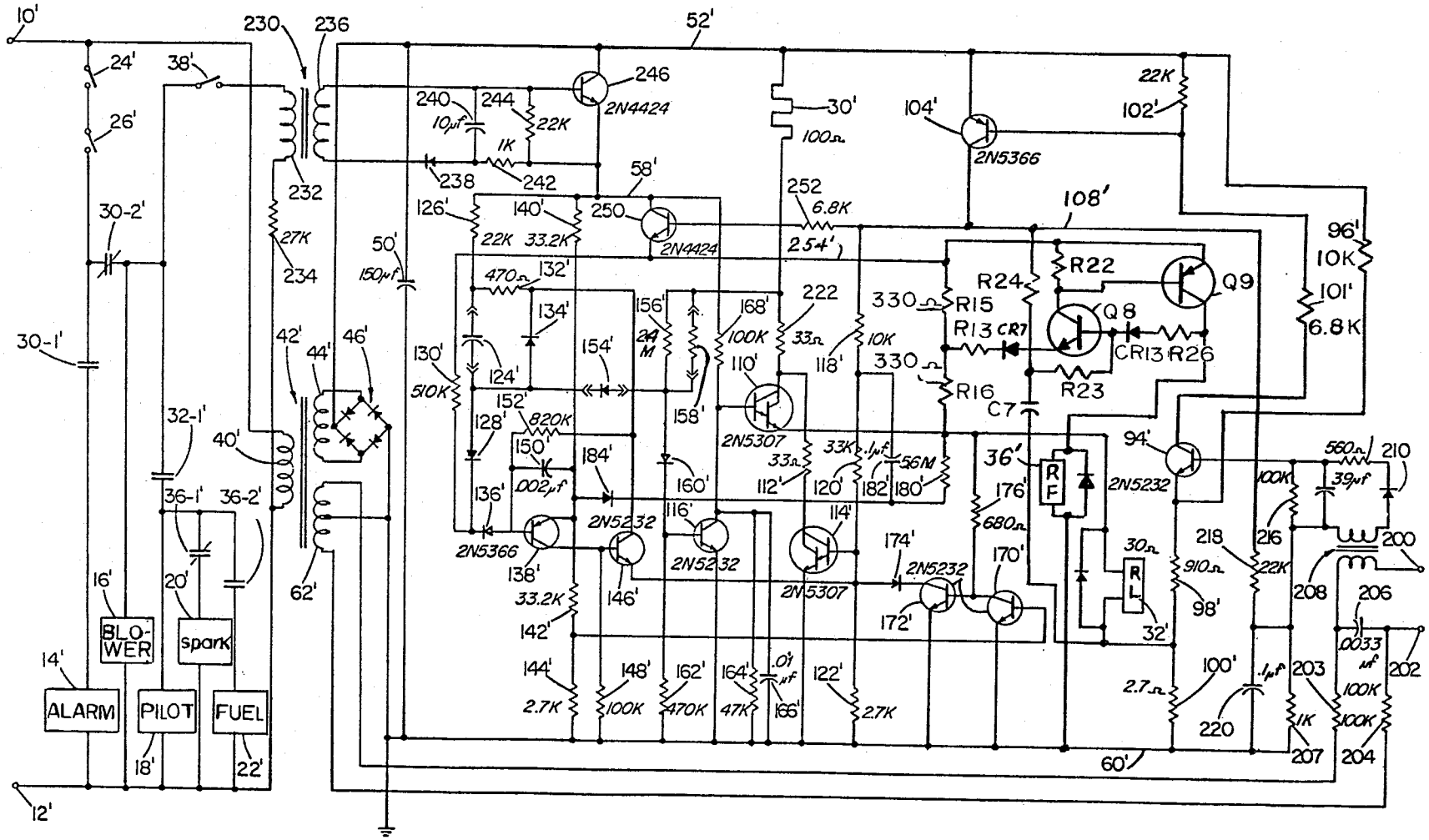
FIG. 2 is a wiring diagram showing the application of the present invention to one of the embodiments of applicant's above-referenced copending application.

With reference to FIG. 2, the illustrated burner control arrangement includes terminals 10', 12', adapted to be connected to a suitable source of power, a typical source being a 120-volt, 60-Hertz source. Connected to those terminals is a control section that includes alarm device 14', blower 16', pilot fuel control 18', spark ignition control 20', and main fuel control 22'. Limit switch 24' and operating control 26' such as a thermostat are connected in series to terminal 10'. Normally open lockout contacts 30-1' are connected in series with alarm device 14' and normally closed lockout contacts 30-2' are connected in series between operating control 26' and the other devices of the control section. Normally open control relay contacts 32-1' control the application of power to the ignition, pilot and fuel controls 18', 20' and 22'; normally closed flame relay contacts 36-1' are connected in series with the ignition control 20'; and normally open flame relay contacts 36-2' are connected in series with main fuel control 22'. The primary winding 40' of transformer 42' is connected directly to terminals 10', 12' so that bus 52' is continuously energized. A first secondary winding 44' of transformer 42' has a full wave rectifier 46' connected across its terminals to provide DC power for the electronics sections, that power being applied to main bus 52' and through transistor 246 to auxiliary bus 58'. The secondary winding 62' of that transformer supplies power to terminals 200, 202 to which a flame sensor of the UV type is connected. The flame signal pulses are coupled by transformer 208 and a rectifier circuit that includes diode 210 to the base electrode of transistor 94'. Transistor 94' in turn controls transistor 104' to apply power to flame signal bus 108'.

Lockout circuitry connected to bus 52' includes a thermally responsive lockout actuator 30' and two actuating circuits, a first actuating circuit through Darlington pair 110', control relay actuator 32' and resistor 100' to ground bus 60' and a second actuating circuit through resistor 112' and Darlington pair 114' to ground bus 60'. The control electrode of Darlington pair 110' is connected to transistor 116' while the control electrode of Darlington pair 114' is connected to a voltage divider network of resistors 118', 120' and 122' connected between flame signal bus 108' and ground bus 60'.

Connected to auxiliary bus 58' is a timing circuit that includes tantalum timing capacitor 124' whose positive terminal is connected to bus 58' through resistor 126' and whose negative terminal is connected to bus 254' through diode 128' and resistor 130'. Connected across timing capacitor 124' are resistor 132' and diode 134'. Connected to the junction between diode 128' and resistor 130' via diode 136' is the base of transistor 138' whose collector is connected to a voltage divider network that includes resistors 140', 142' and 144'. The collector of transistor 138' is connected to the base of transistor 146'. Capacitor 150' is connected between the emitter and base of transistor 138', while resistor 152' is connected between the collector of transistor 146' and the base of transistor 138'.

Connected between the negative terminal of timing capacitor 124' and lockout actuator 30' is a network of diode 154' and resistors 156' and 158'. Diode 160' connects diode 154' to the base of transistor 116'. Darlington pair 110' is triggered into conduction by the turn off of transistor 116'.

Circuitry for control of Darlington pair 114' includes transistors 170', 172', the collector of transistor 172' being connected via diode 174' to the control electrode of Darlington pair 114'. Darlington pair 114' is triggered into conduction in response to a flame signal on bus 108' applied through voltage divider network of resistors 118', 120' and 122' or conduction of transistor 146' unless its control electrode is clamped to ground by transistor 172' in conduction. The base of transistor 172' is connected by resistor 176' to line 178'.

An unlatching network, responsive to loss of signal on bus 108', includes resistor 180', coupling capacitor 182' and diode 184' and is connected to the emitter of transistor 138. Timing capacitor 124', diode 154' and resistor 158' are mounted on a plug in timing card and enable the pre-ignition and trial-for-ignition time intervals to be readily changed. The following are values of particular cards for use in this embodiment.

| Capacitor 124' | Resistor 158' | Pre-Ignition | Trial-for-Ignition |
|---|---|---|---|
| 15 μf | 750 K | 7 sec. | 10 sec. |
| 68 μf | 150 K | 30 sec. | 10 sec. |
| 180 μf | 47 K | 90 sec. | 10 sec. |

In operation, limit switch 24' is normally closed, and in response to a call for burner operation, switch 26' closes and power is applied to the control section. Blower 16' is energized through normally closed lockout contacts 30'-2'. When air flow switch 38' closes, power is applied via transformer 42' and rectifier 46' to the electronics section. The electronics section times two successive intervals, a first (pre-ignition) interval T1 in which capacitor 124' is charged and a second interval T2 in which the capacitor 124' is discharged. As capacitor 124' charges, the voltage at the junction between diodes 128' and 136' drops towards the voltage on ground bus 60', controlling the first (pre-ignition) purge time delay interval T1 as a function of the RC values in that capacitor charging circuit (through resistor 130', relay actuators 36' and 32', and resistor 100'). When the voltage at that junction has dropped sufficiently, transistor 138' turns on, the resulting current flow turns on transistor 146' and a signal is fed back through resistor 152' to maintain (latch) transistor 138' in conducting condition. Conduction of transistor 146' abruptly drops the voltage on the plus side of capacitor 124'. This voltage transition is coupled by diodes 154' and 160' to turn off transistor 116' and to turn on Darlington pair 110'. As a result, current flows through a low resistance path of lockout actuator 30', auxiliary relay actuator 34', Darlington pair 110', line 178', control relay actuator 32' and resistor 100'. Relay 32' is pulled in, closing contacts 32'-1' and energizing pilot fuel control 18' and ignition control 20', establishing an ignition condition in the supervised combustion chamber. Transistor 170' is turned off by conduction of transistors 138' and 146' and the signal on line 178' is coupled by resistor 176' to turn transistor 172' on, clamping the control electrode of Darlington pair 114' to ground and thus holding the alternate lockout actuator energizing path non-conductive. The voltage rise at the junction of resistor 100' and relay actuator 32' compensates for the voltage drop on supply bus 52' which occurs when the low resistance path through Darlington pair 110' is conductive so that there is no marked change in the reference voltage at the emitter of transistor 94' and thus stabilizes the response of the flame sensing circuitry to signals at terminal 64'.

In the ignition timing interval, capacitor 124' discharges at a rate determined essentially by the value of capacitor 124' and resistor 158'. The potential on the base of transistor 116' rises and when transistor 116' is turned on, Darlington pair 110' is turned off, terminating the second interval T2. In normal operation, during this discharging interval T2 of capacitor 124' and prior to the turn off of Darlington pair 110', flame is established and a flame signal from the flame sensing circuitry is applied at the base of transistor 104', turning on that transistor and applying the B+ voltage to bus 108'.

Should the flame sensor connected at terminals 200, 202 spuriously indicate the presence of flame in the combustion chamber, its flame signal via transistor 94' causes conduction of transistor 104' which applies a signal through the divider network of resistors 118', 120' and 122' to raise the potential on the control electrode of Darlington pair 114' and turn on that switch, completing an energizing path for the lockout actuator 30', this energizing path being through actuator 30', resistor 222, resistor 112', and Darlington pair 114' to ground bus 60'. Thus lockout actuator 30' is energized even though there is no request for burner operation and if the spurious flame condition persists, the burner system will lockout, opening contacts 30-2' (preventing operation of the burner system) and closing contacts 30-1' (energizing alarm 14'). The burner control electronics do not respond and neither relay 32' or 36' is energized as there is no power on bus 58' during off heat intervals.

Auxiliary transformer 230 has its primary winding 232 connected in series with air flow switch 38' and its secondary winding 236 connected through a rectifier circuit that includes diode 238 to the base of transistor switch 246. When air flow switch 38' is closed, power is applied through transformer 230 to close switch 246 and apply B+ power from bus 52' to bus 58'.

Thus, the flame sensing and lockout circuits are continuously energized (independent of a call for heat) and in response to a call for heat and consequent operation of blower 16' to establish sufficient air flow to close switch 38', transistor 246 is triggered into conduction to apply power to bus 58' and energize the timing circuitry to commence the timing of sequential intervals controlled by the charging and discharging of capacitor 124'. Capacitor 124', diode 154' and resistor 158' are mounted on a plug in unit and thus enable ready change of the timing of either or both intervals. A first (pre-ignition) time interval T1 is controlled as a function of the RC values in the capacitor charging circuit and at the end of that interval transistors 138' and 146' are triggered into conduction. That action latches both transistors 138' and 146' and connects the plus side of capacitor 124' to resistor 122', abruptly dropping the voltage applied to diode 160'. This voltage transition turns off transistor 116' and Darlington pair 110' is switched into conduction producing current flow through lockout actuator 30', resistor 222, Darlington pair 110'', bus 178', control relay coil 32' and resistor 100'. Thus, at the initiation of the second (ignition) interval T2 heating of the lockout actuator 30' commences and simultaneously relay 32' is pulled in, initiating an ignition condition by energizing pilot fuel control 18' and spark transformer control 20'. Conduction of transistor 146' also turns off transistor 170' and the voltage on bus 178' supplied to the base of transistor 172' through resistor 176' turns on clamp transistor 172', clamping the control electrode of Darlington pair 114' to the ground bus 60' through diode 174' and preventing turn on of Darlington pair 114'. This alternate lockout actuator energizing path remains disabled as long as the transistors 138', 146' are latched in conducting condition and there is voltage on bus 178'.

As capacitor 124' discharges, the potential at the base of transistor 116' rises. After a time interval determined essentially by the value of capacitor 124' and resistor 158', transistor 116' is turned on again, turning off Darlington pair 110 and terminating the second (ignition) time interval T2 and, if an alternate control relay energizing path (through flame relay 36') has not been established, deenergizing control relay actuator 32'. When power is removed from bus 178' clamp transistor 172' is released so that the voltage at the control electrode of Darlington pair 114' rises (transistor 146' being turned on), turning on that switch 114' and continuing the heating of lockout actuator 30' through the alternate energizing path until the end of its time delay when it opens normally closed contacts 30-2', shutting down the burner system, and closes normally open contacts 30-1', energizing alarm 14'.

This lockout sequence is interrupted by appearance of flame signal pulses at terminals 200, 202 which switches on transistors 104' and 250. The emitter of transistor switch 250 is connected to bus 254 and application of power to that bus completes an alternate relay actuator maintaining circuit through actuators 36' and 32'. The junction of diodes 128' and 136' is also brought to B+ through resistor 130'.

The flame signal on bus 108' is also applied to the divider network of resistors 118', 120' and 122' and capacitor 182' is charged. Should there be a flame failure removing the flame signal from bus 108', the signal transition will be coupled by capacitor 182' and release the latched transistors 138', 146' and the circuit will automatically recycle through the two sequential timing intervals. If the unlatching circuit of capacitor 182' and diode 184' is omitted in either embodiment, flame failure will cause transistor 104' to cease conduction, the resulting absence of voltage on bus 178' will release the clamp on the control terminal of Darlington pair 114' and the alternate lockout energizing circuit will be switched into conduction because of latched transistor 146'. In such embodiments the system will lockout without recycle on flame failure.

In the present invention the detection of flame initiates a third timing interval T3 which is achieved with the circuit arrangement now to be described.

To accomplish the timing interval T3 a time delay circuit is added to respond to the flame detection signal which is derived from transistor 250 to actuate the flame relay 36'. The flame detection signal from transistor 250 is applied to a voltage divider R15, R16 which is returned through load relay 32'. The voltage divider R15, R16 provides the reference point for a timing circuit which is comprised of resistor R24 and capacitor C7 connected to a positive supply on bus 108' when flame signal is present and returned to the essentially ground level at resistor 100'. From the junction of resistor R24 and capacitor C7 a resistor R23 is connected to the base of transistor Q8 to provide a path through the base emitter path of Q8 and a diode CR7 and resistor R13 to the midpoint of voltage divider R15, R16 which is the reference voltage for the timing circuit.

Transistor Q8 has its collector connected through resistor R22 to the emitter of transistor 250 which supplies voltage during the lockout current flow interval through transistor 250 and when a flame signal is present as detected by switching on transistor 104'. The collector Q8 drives the base of a transistor Q9 which has its emitter also connected to the emitter of transistor 104' and its collector connected to supply current to the flame relay 36'. The collector of Q9 is also connected through a feedback circuit consisting of R26 and diode CR13 to the base of Q8 and with this feedback connection transistors Q8 and Q9 form a switching circuit which switches when the voltage level at the junction of R24 and C7 reaches a level slightly above the reference voltage level provided at the junction between resistors R15 and R16. When switching occurs pickup current through Q9 energizes relay 36' to cause the circuits controlled by the contacts of the flame relay 36' to switch thereby providing for energizing the main fuel valve to turn on and deenergizing the spark ignition so that it is turned off.

With this arrangement the timing interval T3 is introduced starting at the instant flame is detected during the T2 interval and running for a predetermined time so that the desired pilot flame stabilization interval is achieved as previously described wherein pilot stabilization occurs with the spark ignition being maintained as the pilot flame stabilizes. The delay in turning on the main fuel during the stabilization interval results in the pilot flame being sufficiently stabilized so that the possibility for it to be blown out by turning on the main fuel valve is minimized.

Figure 1:
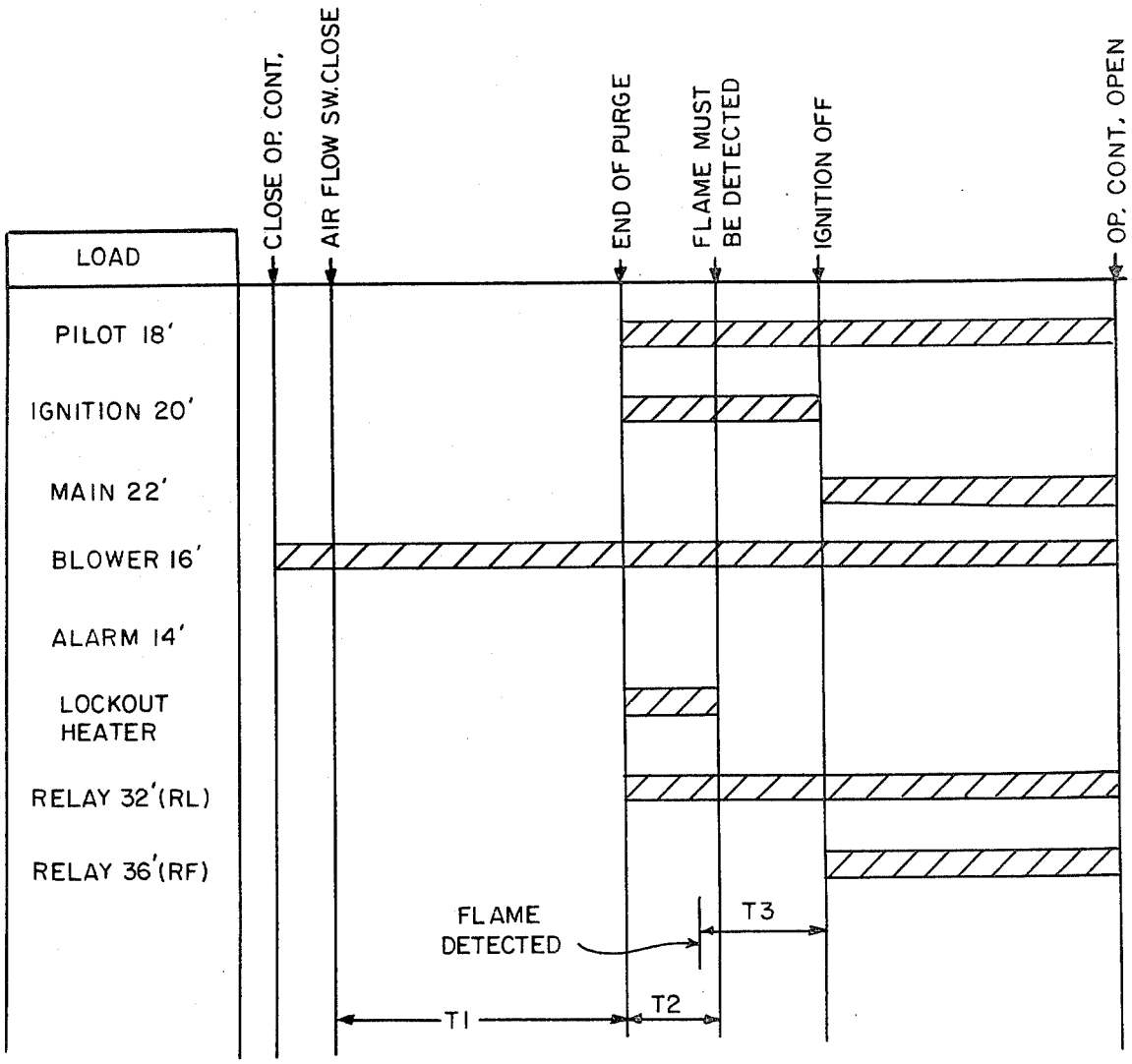
FIG. 1 is a timing diagram of the system of the present invention useful in describing operation of various control components.

In the circuits of the referenced copending application the spark ignition is discontinued as soon as pilot flame is detected which sometimes results in extinguishing the pilot flame when the main fuel burner is turned on. In order to make the ignition sequence more reliable as shown in the timing diagram of FIG. 1, the present invention introduces a time delay T3 which starts at flame detection and runs for a predetermined period of time after which the flame relay is actuated to turn on the main fuel valve and extinguish ignition. In this arrangement the electric ignition interval is extended relative to the prior circuit to terminate at the end of the timing interval T3 for picking up the flame relay such that there is electric ignition spark present while the pilot flame is stabilizing during this additional timing interval T3. Thus when the flame relay picks up after the time delay T3 the pilot flame is fully stabilized and opening the main fuel valve for the main flame produces ignition due to the fully stabilized pilot flame being immune from being extinguished by turning on the main fuel valve.

From the present description those skilled in the art will perceive how the invention can be applied to various other circuits including those of the referenced copending application. The invention, accordingly, is not to be considered as limited to the specific disclosed embodiment but only by the scope of the appended claims.

I claim:

1. Burner control apparatus for use with a fuel burner installation having an operating control to produce a request for burner operation, a flame sensor to produce a signal when flame is present in said fuel burner installation, and means responsive to said burner control apparatus for controlling fuel flow, said burner control apparatus comprising:

a control device for actuating said fuel control means;

electronic accumulator timing circuit means operable for providing first and second successive timing periods of precise duration to provide a pre-ignition timing interval and an ignition timing interval;

means responsive to a request for burner operation to initiate an ignition sequence by actuating said timing circuit;

circuitry responsive to said actuated timing circuit for energizing said control device at the end of said first timing interval to initiate ignition and pilot fuel supply for said burner;

flame signal responsive circuitry responsive only during said ignition timing interval to detection of a flame signal from said flame sensor to deactuate said timing circuit means and initiate a third timing interval which extends beyond the normal end of said ignition timing interval; and means responsive to the end of said third timing interval for initiating main fuel supply to said burner and terminating said ignition.

2. The apparatus as claimed in claim 1 wherein said control device energizing circuitry also energizes lockout circuitry and further including compensating circuitry to provide power supply compensation to stabilize the sensitivity of said flame signal responsive circuitry during the concurrent energization of said lockout circuitry and said control device.

3. The apparatus as claimed in claim 2 wherein said flame signal responsive circuitry includes a reference voltage provided by a voltage divider network connected to the power supply for said control circuitry and said compensation circuitry is connected to shift the voltage on said divider network and stabilize said reference voltage.

4. The apparatus as claimed in claim 1 and further including lockout circuitry for deenergizing said control apparatus comprising a switch, an actuator for operating said switch and two alternate paths for energizing said actuator, said control device is connected in one of said lockout actuator energizing paths, said timing circuit energizes said one lockout actuator energizing path at the end of said first timing interval, and said timing circuit deenergizes said one lockout actuator energizing path and energizes the other lockout actuator energizing path at the end of said second timing interval in the absence of a signal from said flame sensor.

5. The apparatus as claimed in claim 4 and further including a pilot fuel control connected to said one lockout actuator energizing path.

6. Burner control apparatus for use with a fuel burner installation having an operating control to produce a request for burner operation, a flame sensor to produce a signal when flame is present in said fuel burner installation, and means responsive to said burner control apparatus for controlling fuel flow, said burner control apparatus comprising:

a control device for actuating said fuel control means;

a timing circuit for providing first and second successive timing periods of precise duration to provide a preignition timing interval and an ignition timing interval;

means responsive to a request for burner operation to initiate an ignition sequence by actuating said timing circuit;

circuitry responsive to said actuated timing circuit for energizing said control device at the end of said first timing interval to initiate ignition and pilot fuel supply for said burner;

flame signal responsive circuitry responsive to detection of a flame signal from said flame sensor to initiate a third timing interval; and means responsive to the end of said third timing interval for initiating main fuel supply to said burner and terminating said ignition, said first and second timing intervals being obtained by charging and discharging a common capacitor which is mounted on a plug in unit.

7. The apparatus as claimed in claim 6 wherein also mounted on said plug in unit is a resistor that cooperates with said common capacitor in determining the duration of a timing interval provided by said timing circuit.

8. The apparatus as claimed in claim 7 and further including lockout circuitry for deenergizing said control apparatus and said plug in unit includes a further circuit component, said further circuit component being connected between said timing circuit and said lockout circuitry when said plug in unit is inserted in said control apparatus, said timing circuit and said lockout circuitry being arranged so that, when said plug in unit is not inserted in said control apparatus, said lockout circuitry is energized in response to a request for burner operation and energization of said control device is prevented.

9. Burner control apparatus for use with a fuel burner installation having an operating control to produce a request for burner operation, a flame sensor to produce a signal when flame is present in said fuel burner installation, and means responsive to said burner control apparatus for controlling fuel flow and fuel ignition, said burner control apparatus comprising:

a main control device for actuating said fuel and ignition control means;

a pilot fuel control device connected in a series circuit with a lockout actuator means and said main control device for energization concurrent therewith;

electronic accumulator timing circuit means operable for providing first and second successive timing periods of precise duration to provide a preignition timing interval and an ignition timing interval;

means responsive to a request for burner operation to initiate an ignition interval by actuating said timing circuit;

circuitry responsive to said actuated timing circuit for energizing said series circuit at the beginning of said ignition interval;

flame signal responsive circuitry responsive only during said ignition timing interval to a signal from said flame sensor to deactuate said timing circuit means and initiate a further timing interval to maintain said pilot fuel control device energized to maintain ignition beyond the normal end of said ignition timing interval; and means responsive to the end of said further timing interval to deenergize said series circuit and said pilot fuel control device and to energize said main control device to actuate the main fuel control means to supply main fuel to said burner and to deenergize said ignition control means.

10. Burner control apparatus for use with a fuel burner installation having an operating control to produce a request for burner operation, a flame sensor to produce a signal when flame is present in said fuel burner installation, and means responsive to said burner control apparatus for controlling fuel flow and fuel ignition, said burner control apparatus comprising:

a main control device for actuating said fuel and ignition control means;

a pilot fuel control device connected in a series circuit with said lockout actuator and said main control device for energization concurrent therewith;

a timing circuit;

means responsive to a request for burner operation to initiate an ignition interval by actuating said timing circuit;

circuitry responsive to said actuated timing circuit for energizing said series circuit at the beginning of said ignition interval;

flame signal responsive circuitry responsive to a signal from said flame sensor to initiate a further timing interval, maintain said pilot fuel control device energized; and means responsive to the end of said further timing interval to deenergize said series circuit and said pilot fuel control device to actuate the main fuel control means to supply main fuel to said burner and to deenergize said ignition control means, said timing circuit providing first and second successive timing intervals of precise duration, a pre-ignition timing interval and an ignition timing interval, said first timing interval being a function of the charging of a capacitor and said second timing interval being a function of the discharging of said capacitor, and said further timing interval being initiated only during said second timing interval.

11. The apparatus as claimed in claim 10 and further including circuitry responsive to loss of a flame signal from said flame sensor after flame has been established to cause said timing circuit to provide at least a further ignition timing interval.

* * * * *